US008978437B2

(12) United States Patent
Malas et al.

(10) Patent No.: US 8,978,437 B2
(45) Date of Patent: Mar. 17, 2015

(54) NOZZLE HEADER

(75) Inventors: Akin Malas, Munich (DE); Brian King, Godalming (GB); Laszlo Szeman, Munich (DE); Peter D. Smith, Poole (GB); Paul Bowcher, Broadstone (GB); Mike Clark, Sheffield (GB); Peter Christoforou, Sheffield (GB)

(73) Assignees: Linde Aktiengesellschaft (DE); Siemens PLC (GB)

( * ) Notice: Subject to any disclaimer, the term of this patent is extended or adjusted under 35 U.S.C. 154(b) by 99 days.

(21) Appl. No.: 13/980,379

(22) PCT Filed: Feb. 16, 2012

(86) PCT No.: PCT/EP2012/000688

§ 371 (c)(1),
(2), (4) Date: Nov. 21, 2013

(87) PCT Pub. No.: WO2012/110241

PCT Pub. Date: Aug. 23, 2012

(65) Prior Publication Data

US 2014/0070020 A1 Mar. 13, 2014

(30) Foreign Application Priority Data

Feb. 17, 2011 (EP) ..... 11001322

(51) Int. Cl.
*B21B 27/10* (2006.01)
*B21B 45/02* (2006.01)

(52) U.S. Cl.
CPC ..... *B21B 45/0233* (2013.01); *B21B 45/0218* (2013.01); *B21B 27/10* (2013.01); *B21B 45/0209* (2013.01); *B21B 2027/103* (2013.01); *B21B 2045/0212* (2013.01)
USPC ..... 72/201

(58) Field of Classification Search
CPC ..... B21B 27/10; B21B 2027/103; B21B 45/0218; B21B 45/0233
USPC ..... 72/201, 373
See application file for complete search history.

(56) References Cited

U.S. PATENT DOCUMENTS 4,061,010 A * 12/1977 Stock et al. ..... 72/236
4,422,318 A * 12/1983 Christ et al. ..... 72/201
4,653,303 A * 3/1987 Richard ..... 72/45
4,934,444 A * 6/1990 Frischknecht et al. ..... 72/201
5,046,347 A * 9/1991 Crosato et al. ..... 72/201
5,473,924 A * 12/1995 Collinson ..... 72/236

(Continued)

FOREIGN PATENT DOCUMENTS

WO WO 2006/074875 A1 7/2006

OTHER PUBLICATIONS

International Search Report for PCT/EP2012/000688, Date of Mailing: Mar. 26, 2012, Authorized Officer: Ralph Gruber, 10 pp.

*Primary Examiner* — David B Jones
(74) *Attorney, Agent, or Firm* — Joshua L. Cohen

(57) ABSTRACT

An apparatus and a method provided for spraying a coolant to a work piece include a coolant feed line, at least one delivery nozzle for delivering the coolant, and shielding means which surround at least part of said delivery nozzle. The shielding means are arranged with the work piece to form an essentially closed space, and said shielding means includes exhausting means for exhausting gas from the essentially closed space, and means for keeping the outside of the shielding means at a temperature above the dew point.

17 Claims, 5 Drawing Sheets

(56) References Cited

U.S. PATENT DOCUMENTS

| | | | | |
|---|---|---|---|---|
| 6,385,989 | B1 * | 5/2002 | Cassidy | 72/201 |
| 2002/0162374 | A1 | 11/2002 | Plicht et al. | |
| 2007/0175255 | A1 | 8/2007 | Pawelski et al. | |
| 2010/0275620 | A1 | 11/2010 | Zurecki et al. | |
| 2011/0308288 | A1 | 12/2011 | McRae et al. | |

* cited by examiner

NOZZLE HEADER

The invention relates to an apparatus and method for spraying a coolant to a work piece.

It is well known that metal rolling processes produce a lot of heat and that the most common method for removing this heat is to spray a coolant onto the rolls. The most common coolants are water and kerosene but recently the use of cryogenic fluids has been suggested in GB2466458A and DE102005001806.

A major problem with the use of cryogenic fluids for cooling in some metal rolling processes such as the cold rolling of aluminium is that moisture from the surrounding atmosphere can condense onto the equipment and form water, ice or snow which can then fall or be carried onto the strip and damage it.

DE102005001806 proposes to minimise condensation by measuring the roll temperature and controlling the flow of cyrogenic fluid so that the roll is not over cooled. However experiments have shown that even if the surface of the roll itself is maintained at the correct temperature the large quantity of cold gas that is produced causes cooling of the surrounding air and equipment and this leads to condensation.

GB2466458 proposes to avoid the formation of condensation by surrounding the rolling mill with an inner chamber which contains only the inert dry gas and maintaining this inner chamber at a positive pressure in order to prevent air containing moisture from entering the inner chamber. This method prevents the formation of condensation within the inner chamber but experiments have shown that the large quantity of cold gas inside the inner chamber causes the sheet material which forms the inner chamber to become cold and therefore condensation forms on this sheet material on the outside of the inner chamber. Having formed on the outside of the inner chamber it is still possible for the condensation to fall onto the strip and damage it. Another disadvantage of the chamber proposed in GB2466458 is that all of the equipment which is inside the inner chamber becomes chilled by the cold gas and this causes problems with bearings, hydraulic systems and other equipment which are inside the chamber.

Another method of avoiding condensation is proposed in EP1406738 B1. For metallurgical and roll bite friction reasons the cryogenic fluid in this case is used to cool the strip directly instead of cooling the rolls but the principles are similar. EP1406738 B1 proposes to shroud the nozzles by blowing a dry gas around the nozzles. However, that dry inert gas shroud only prevents condensation on the nozzles themselves. It does not prevent condensation in the surrounding atmosphere and other equipment in the vicinity which is exposed to the cold gas. The cyrogenic sprays produce a large quantity of cold gas which chills the surrounding air and other equipment in the vicinity of the sprays and this leads to condensation. Furthermore, the dry inert gas as well as the evaporated nitrogen displace the air and can reduce the oxygen content in the atmosphere at the work place.

An object of the present invention is to avoid getting any water onto the work piece.

Furthermore, the gas generated by evaporation of the liquid nitrogen could cause turbulence which affects the spraying efficiency.

Therefore, it is an object of the invention to provide an apparatus and a method for spraying a coolant, especially a liquified gas, in which turbulence produced by the evaporation of the liquified gas is reduced.

Another object of the invention is to provide a method and an apparatus for spraying a coolant, especially a liquified gas, wherein the oxygen content in the work environment is not or at least not substantially reduced.

Another object of the invention is to provide an apparatus and method for spraying a cryogenic coolant in a process of rolling a metal strip which prevents the formation of condensation in any area or on any equipment from which the water could get onto the metal strip.

This object is achieved by an apparatus for spraying a coolant to a work piece comprising a coolant feed line, at least one delivery nozzle for delivering the coolant and shielding means which surround at least part of said delivery nozzle, wherein said apparatus is characterized in that said shielding means are arranged to form an essentially closed space together with the work piece, and said shielding means comprise exhausting means for exhausting gaseous coolant from the essentially closed space to a location remote from the work piece, and further comprising means for keeping the outside of said shielding means at a temperature above the dew point.

This object is also achieved by a method for spraying a coolant to a work piece wherein said coolant is sprayed by means of at least one delivery nozzle, and wherein shielding means are provided which surround at least part of said delivery nozzle, and which is characterized in that said shielding means are arranged to form an essentially closed space together with the work piece, wherein gaseous coolant is withdrawn from the essentially closed space to a location remote from the work piece, and the outside of said shielding means is kept at a temperature above the dew point.

The dew point is defined as the temperature at which at a given pressure water vapour will condense into water. According to the invention, the temperature of the outer walls of the shielding means shall be above the dew point of the surrounding ambient air. In particular, the outside of the shielding means shall be kept at a temperature of at least a few degrees centigrade above the dew point temperature of the ambient air. In a preferred embodiment the shielding means are kept at least at the temperature of the surrounding atmosphere.

The shielding means preferably comprises an enclosure, a shell or a box-like element with an opening arranged to be turned towards the workpiece. The edge of the shielding means which is directed towards the work piece is preferably designed to form a seal with the work piece.

According to the invention the shielding means are arranged to form an essentially closed space together with the work piece. The essentially closed space is delimited by the shielding means and by at least a portion of the work piece. The outlet of the delivery nozzle for the coolant is located inside the essentially closed space. Thus, the coolant is sprayed into the essentially closed space and contacts and cools that portion or area of the work piece which forms a boundary of the essentially closed space. Gaseous coolant is withdrawn from the essentially closed space and passed to a location remote from the work piece.

According to the invention the outside of the shielding means are kept at a temperature above the dew point of the surrounding atmosphere. The invention prevents any gas, surface or part outside the essentially closed space from being cooled to a temperature below the dew point. Accordingly, large amounts of coolant and vaporized coolant can be handled in a closed system wherein only the desired portion of the work piece is cooled down. Any other area or any other equipment is kept at a temperature above the dew point. The ambient atmosphere in the work piece area outside the essentially closed space does not experience any temperature below the dew point and condensation is prevented. The invention not only prevents condensation on the delivery nozzle or icing of the delivery nozzle, but also in the area around the work piece.

Thus, the essentially closed space achieves two things:

It prevents condensation or icing from occurring inside the closed space, on the nozzles or on the workpiece because the ambient atmosphere is excluded and the closed space only contains cold dry gas and coolant.

It prevents condensation or icing outside of the closed space because the outside of the shielding means are kept above the dew point and the cold gas is exhausted away from the mill.

The invention is in particular used for cooling in a metal rolling process of rolling a metal strip. In that case the essentially closed space is defined by the shielding means and the part of the outside surface of the work roll which shall be cooled. In this case the work roll is the work piece which is sprayed with the coolant. The opening of the shielding means is closed by the work roll thereby forming an essentially closed space inside. The essentially closed space preferably does not include the whole of the workpiece, in this case not the whole of the work roll. The invention prevents condensation outside the essentially closed space and thus no water, ice or snow is formed which could fall onto the metal strip and damage it.

According to another preferred embodiment, the shielding means comprises a sealing member arranged to sealingly close the gap between the shielding means and the work piece. Preferably, the sealing means extend at least around a part of the opening of the shielding means, more preferred along the total circumference of the opening of the shielding means towards the work piece. The sealing member can comprise an elastic material, for example a plastic material. The sealing means between the shielding means and the work piece prevent gaseous coolant below the dew point from escaping from the essentially closed space into the area local to the work piece.

In another embodiment the shielding means are provided close enough to the work piece in order to allow the creation of a pressure barrier which prevents any gas below the dew point from escaping from the essentially closed space into the area local to the work piece.

The sealing member can further comprise a gas seal, i.e. a gas flow which prevents atmospheric air from entering the closed space and, equally if not more important, prevents the cold gaseous coolant from escaping from the closed space into the vicinity of the workpiece.

The invention as a whole forms a closed system or an essentially closed system for the coolant and its associated low temperature gas (gaseous coolant) which prevents the ambient atmosphere in the workpiece area from experiencing any temperatures below its dew point.

According to the invention the outside of the shielding means shall be kept at a temperature above the dew point of the surrounding ambient air, preferably above the temperature of the surrounding ambient air. The means to keep the temperature of the outside of the shielding means in the desired range may include passive elements, such as thermal insulation, which reduce the rate of heat transfer between the inside of the closed space and the outside walls of the shielding means. These means preferably comprise material with a low heat transfer coefficient, for example one or more layers of a solid material with a low thermal conductivity. Further, the means for keeping the outside of said shielding means at a temperature above the dew point may also include active elements which keep the wall temperature above the dew point by heat supply, for example by provision of heating means, in particular electric heating means.

According to another preferred embodiment the shielding means are at least partly double-walled and a source of a gas is connected to the gap between said walls. The shielding means comprise an inner and an outer wall and a gas is introduced into the gap between these walls in order to act as an insulator and to provide a source of heat to keep the outer wall above the dew point. Preferably a gas is used which is at ambient temperature or even above ambient temperature or which has been warmed up to a temperature above ambient temperature.

It is further preferred that the gap between the walls of the shielding means comprises a gas outlet at or close to the gap between the shielding means and the work piece. Part of the gas which is introduced into the gap between the walls of the shielding means flows out of the gas outlet near the work piece. The gas acts as a shroud, gas seal or pressure barrier and prevents atmospheric air from entering through this gap into the essentially closed space and cold gas from escaping from the closed space into the vicinity of the workpiece. Therefore, any condensation is kept away from the essentially closed space and the cold inner parts of the system.

Instead of or in addition to the gas outlet(s) mentioned above it is also possible to have a separate gas feed line for feeding a gas, preferably a warm gas, close to the gap between the shielding means and the work piece which then acts as a shroud or gas barrier to prevent cold gas getting out and ambient air getting into the essentially closed space.

The pressure of the gas blown into the vicinity of the gap between the shielding means and the work piece is preferably controlled to be above the atmospheric pressure of the surrounding ambient air and above the pressure inside the essentially closed space. This ensures that neither air is sucked into the essentially closed space nor cold gaseous coolant leaves the essentially closed space through said gap.

It may also be advantageous to add a lubricant to the gas blown in the vicinity of or close to the gap between said shielding means and said work piece. Furthermore, the gas seal or pressure barrier can be enhanced by the addition of physical barriers.

According to the invention a coolant is sprayed via one or more delivery nozzles onto the work piece that shall be cooled. The term delivery nozzle shall mean any kind of outlet, orifice or nozzle for spraying a coolant. In the simplest case the delivery nozzle may be a simple tube end.

When a liquified gas, such as liquid nitrogen, is used as coolant, the nitrogen will evaporate during spraying and displace the air from the volume confined by the shielding means and the work piece. The shielding means are preferably provided with an opening aligned with the orifice of the delivery nozzle(s). The term "aligned" shall mean that the nozzle orifice and the opening of the shielding means are arranged in such a way that the coolant leaving the delivery nozzle passes part of the interior of the shielding means, that is the essentially closed space, and then leaves the shielding means through said opening in order to be sprayed to or onto the work piece. In a preferred embodiment according to the invention, close to the edge of said opening a jet of dry gas, which may have been warmed up before, is blown.

The term 'dry gas' shall mean a gas which contains essentially no water vapour or such a low level of water vapour that no condensation or ice is formed when this gas comes into contact with the coolant or with equipment such as the edge of the interior part of the shielding which has been cooled by the coolant. The dry gas will prevent formation of ice on the shielding means, especially on the edge of the opening. Preferably, the content of $H_2O$ in the dry gas is less than 10 ppm or less than 10 vpm (parts per million by volume).

It has been found that the gas/the gaseous coolant accumulating within the essentially closed space is often turbulent and influences the spray characteristics of the coolant. Furthermore, the gas/gaseous coolant may create a layer on the surface of the work piece to be cooled which may function as a thermal buffer and may protect the work piece from the desired cooling by the sprayed coolant. Therefore, the shielding means are provided with an exhaust duct for withdrawing gas/gaseous coolant from the essentially closed space surrounded by the shielding means. By controlling the amount of gas and/or gaseous coolant withdrawn through the duct it is possible to control the characteristics of the coolant spray. Due to the controlled cooling the surface quality of the work piece will be higher and more uniform.

The exhaust duct also prevents the pressure in the closed space from increasing until cold gaseous coolant starts to escape past the seals (whether plastic seal or gas seal). If gaseous coolant starts escaping then you get condensation outside of the shielding means. Furthermore, the pressure inside the closed space shall not become too low. Otherwise ambient air containing moisture may be sucked into the closed space and then condensation would occur inside the shield. Preferably, the exhaust duct has to maintain the pressure inside the closed space high enough to prevent air getting sucked in and low enough to avoid cold gas escaping past the seals. Furthermore, the exhaust has to take the cold gas away from the critical area in the vicinity of the strip. This is achieved by controlling the flow through the exhaust, for example by using a valve or similar means, and/or by controlling the flow of coolant.

As described above it is preferred to have a gas flow close to the gap between the shielding means and the work piece. The gas flow acts as a shroud or gas barrier to prevent cold gas getting out and ambient air getting in the essentially closed space. Preferably, the pressure of that gas flow is above atmospheric pressure (in order to prevent ambient air from entering the closed space through the gap) and above the pressure inside the essentially closed space (in order to prevent cold gas from leaving the closed space).

According to a preferred embodiment the shielding means are thermally insulated. The thermal insulation will ensure that the outer surface of the shielding means keeps warm even if the temperature within the volume surrounded by the shielding means has substantially decreased. Formation of ice or water droplets on the outside of the shielding means is prevented.

The thermal insulation may also be achieved by providing a vacuum insulation. Further, it is possible to keep the outside wall of the shielding means warm by warming it up electrically.

In a preferred embodiment the thermal insulation is achieved by designing the shielding means at least partly double-walled and passing a gas through the gap between said walls of said shielding means. For that purpose it is in particular preferred to use the gas which shall subsequently be blown to the edge of the opening of the shielding means. It is further possible to provide a shielding means with more than two walls in order to improve the thermal insulation.

According to another preferred embodiment, part of the gaseous coolant which has been withdrawn via the exhaust duct from the interior of the shielding means is re-used as dry gas or gas seal. For that purpose it may be necessary to warm up the withdrawn gaseous coolant before passing it through the gap between the double walls and/or before blowing it to the edge of the opening of the shielding means.

According to a preferred embodiment the shielding means surround more than one delivery nozzle, that is two or more delivery nozzles. Preferably all delivery nozzles for supplying the coolant are located within one shielding means.

The invention is in particular useful when a liquified or cryogenic gas, especially liquid nitrogen, is used as coolant. In that case the delivery nozzle(s) is/are in fluid communication with a source of liquid nitrogen. The term "liquefied gas" shall mean a cold fluid in the liquid phase or as a mixture of liquid and gaseous phase. The gas is preferably an inert gas.

According to another preferred embodiment gaseous nitrogen is used as dry gas. The gas outlet or gas outlets for supplying the dry gas to the edge of the opening are preferably in fluid communication with a source of gaseous nitrogen. It is possible to use other dry gases, in particular inert gases, as dry gas but gaseous nitrogen is preferred.

The invention is preferably used for cooling a work roll and/or a metal strip during a cold rolling process. In cold rolling a metal strip or metal foil is passed through a gap between two counter-rotating rolls. The coolant can be sprayed on the metal strip and/or on the rolls for rolling the metal strip. In terms of the invention, in the first case the metal strip is the work piece, in the second case the work roll or the work rolls are the work piece. It is in particular preferred to use liquid nitrogen as coolant.

It is further preferred to arrange at least part of the cryogen feed line inside the exhaust duct for withdrawing excess cold gas. Thereby, it is ensured that no atmospheric air will contact the cold surface of the cryogen feed line.

Preferably, the width of the gap between said shielding means and said work piece is maintained or controlled. The shielding means can be maintained in the same position in relation to the surface of the work piece, for example by using mechanical means, or if the position of the surface of the work piece may vary, the position of the shielding means can be changed. For example, the diameter of a work roll is often being grinded to improve its performance. As a result the diameter of the roll is being reduced. An example is to use plastic material at the sealing area to reduce the friction between the chamber and the work roll and by pressing the chamber against the work roll surface with low force, the gap between said shielding means and said work roll (in general said work piece) can be maintained at the plastic material's thickness.

Preferably, plastic material or another kind of spacers is used at the edges of the shielding means outside of the area of the roll which contacts the strip. In this area it does not matter if the plastic rubs on the roll surface because that part of the roll is not in contact with the strip. An alternative method of setting or controlling the gap for the gas barrier would be to have a sensor to detect the relative position of shielding means and work piece, an actuator to move the shielding means and/or the work piece and a control system to adjust the position of the shielding means and/or the work piece in order to get the correct gap between said shielding means and said work piece.

It is further advantageous to design the shielding means such that it can be retracted away from the working position for maintenance purposes.

After maintenance or a period when the cooling has not been in use the essentially closed space might contain some water vapour from the ambient air. Therefore, it is preferable to purge the essentially closed space with dry gas before the coolant, in particular a cryogenic cooling, is switched on again. It is preferred to purge the essentially closed space with an amount of gas which is at least 3 times, preferably at least 5 times the volume of the essentially closed space. It is further preferable to purge the essentially closed space and the equipment inside that space with a dry gas and/or to warm up the equipment by electrical heating.

BRIEF DESCRIPTION OF THE DRAWINGS

The present invention will now be more particularly described by way of example with reference to the accompanying drawings, in which.

DETAILED DESCRIPTION OF THE INVENTION

Figure 1:
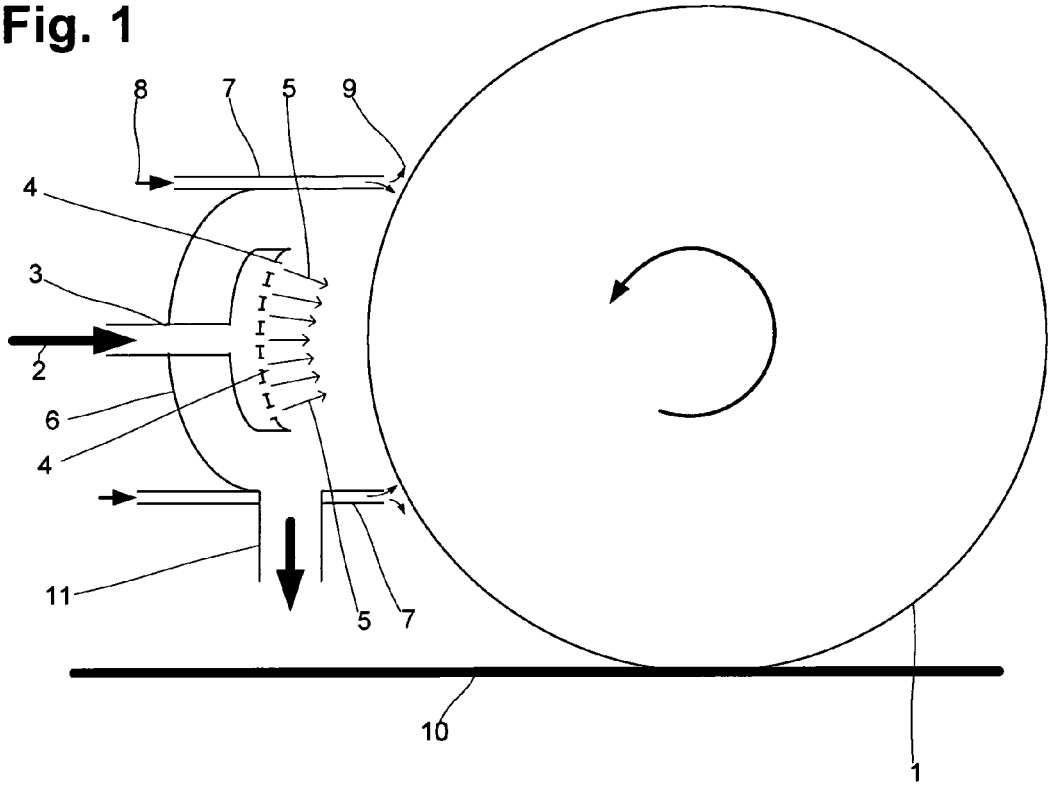
FIG. 1 schematically shows a first embodiment of the invention.

FIG. 1 schematically shows a device or apparatus 20 for spraying liquid nitrogen onto a work roll 1 which is used for cold rolling a metal strip or metal foil 10. Liquid nitrogen 2 is supplied via a supply line 3 to a plurality of delivery nozzles 4. The liquid nitrogen leaves the delivery nozzles 4 in the form of nitrogen jets 5 directed to the surface of the roll 1. During and after the spraying process the liquid nitrogen evaporates and forms gaseous nitrogen.

The delivery nozzles 4 are surrounded by an enclosure 6 which serves as shielding means. The enclosure or shielding means 6 has an opening towards the work roll 1. The shielding means 6 is at least partly designed with double walls 7. Gaseous nitrogen 8 with room temperature is provided to the gap between the two walls 7 of the shielding means 6. The nitrogen gas 8 flows between the two walls 7 and thereby thermally insulates the shielding means 6. The outer surface of the shielding means remains warm although liquid nitrogen is evaporated inside the essentially closed space confined by the shielding means 6 and the work roll 1. The warm gas not only insulates the outer wall but also provides heat. The dry gaseous nitrogen leaves the annular gap between the double walls 7 close to the edge of the opening of the shielding means 6, that is in operation close to the roll 1.

The warm nitrogen gas 9 leaving the gap between the double walls 7 acts as a gas barrier and blocks the small gap between the shielding means 6 and the roll 1 and thus prevents air from entering into the interior of the shielding means 6 and cold gas from escaping. The pressure of the gas flow 9 is above the atmospheric pressure and above the pressure inside the essentially closed space confined by the shielding means 6.

The enclosure or shielding means 6 further comprise a duct 11 which allows to withdraw gas from the essentially closed space confined by the shielding means 6. The gas flow through duct 11 is controlled in such a way that surplus nitrogen gas is extracted from the enclosure 6 and from the surface of the roll 1. That gas would otherwise create a turbulence which may affect the efficiency of the liquid nitrogen spraying. Furthermore, potentially asphyxiating inert nitrogen gas is removed from the work environment. On the other hand, the gas flow through duct 11 should not suck in air from the surroundings into the enclosure 6 via the gap between the enclosure 6 and the roll 1. That means the gas flow through duct 11 is preferably controlled to achieve an optimum of the above described effects. The gas flow through duct 11 is preferably controlled depending on the design of the enclosure 6, the pressure and flow of the liquid nitrogen 2, 5 and/or the pressure and flow of the dry gas 8 passed through the double walls 7.

Preferably, the back of the enclosure 6—behind or upstream of the nozzles 4—and the supply line 3 are insulated to ensure that those parts are above the dew point as well as the double walls 7. It is further preferred to also insulate the exhaust duct 11, at least within the critical region where any condensation on the exhaust duct 11 could get onto the strip 10.

Figure 2:
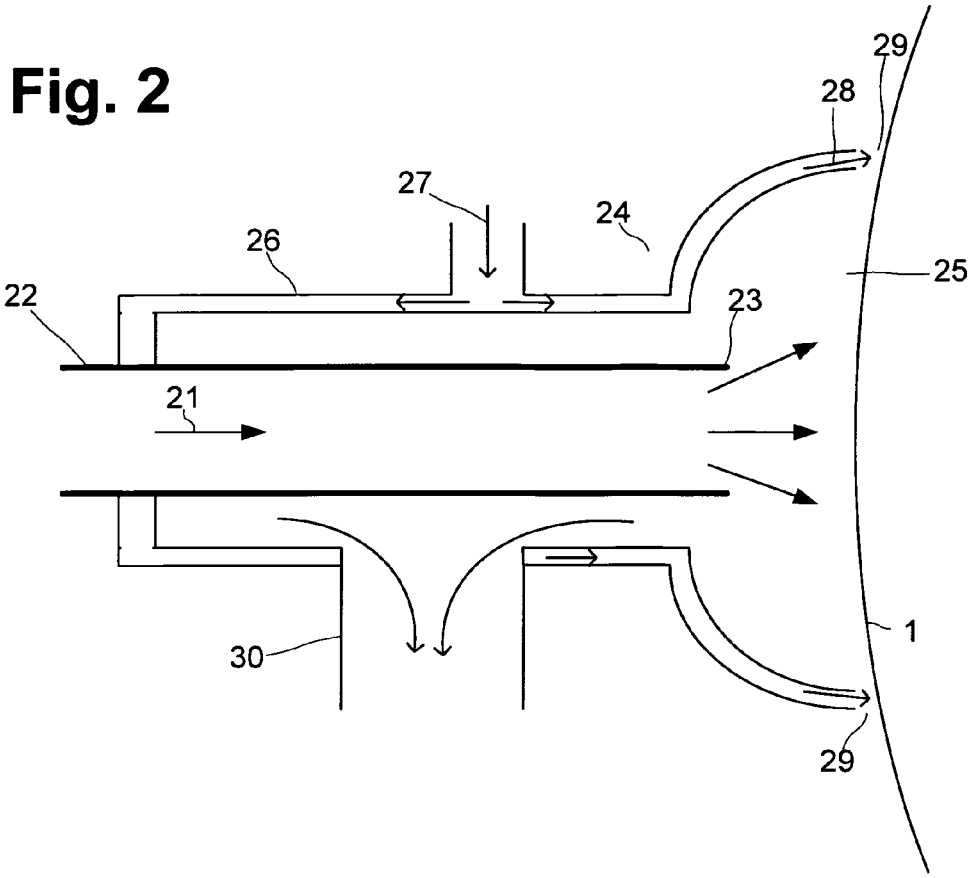
FIG. 2 shows a second embodiment of the invention.

FIG. 2 shows a second preferred embodiment of the invention. FIG. 2 shows a device or apparatus 200 for spraying liquid nitrogen onto a roll 1 which is used for cold rolling a metal strip or metal foil 10. In this embodiment the liquid nitrogen 21 is supplied via a supply line 22 which ends in a delivery nozzles 23. The liquid nitrogen leaves the delivery nozzle 23 and is directed to the surface of the roll 1.

The supply line 22 and the delivery nozzle 23 are at least in part surrounded by a box-like enclosure 24. The box-like enclosure 24 has an opening 25 aligned with the outlet of the delivery nozzle 23 and directed towards the roll 1. The box-like enclosure 24 is arranged close enough to the work roll 1 to allow the creation of a pressure barrier and to prevent gas below the dew point from escaping through the small gap between the enclosure 24 and the work roll 1 into the area local to the work roll 1. The box-like enclosure 24 is provided with double walls 26. Gaseous nitrogen 27 is fed to the gap between the double walls 26 of the box-like enclosure 24. The nitrogen gas 27 fills the gap between the double walls 26 and thereby thermally insulates the box-like enclosure 24. The outer surface of the box-like enclosure 24 remains warm although the interior of the box-like enclosure 24 is cooled down by evaporating nitrogen. The warm nitrogen leaves the annular gap between the double walls 26 close to the edge of the opening 25 of the box-like enclosure 24. Similar to the embodiment according to FIG. 1, the supply line 22 and the exhaust 30 are insulated.

The warm nitrogen gas 28 leaving the gap between the double walls 26 enters the small gap 29 between the box-like enclosure 24 and the roll 1 and thus prevents air from entering into the interior of the box-like enclosure 24 and cold gas from escaping. The box-like enclosure 24 further comprises a duct 30 which allows to withdraw gas from the interior of box-like enclosure 24.

Figure 3:
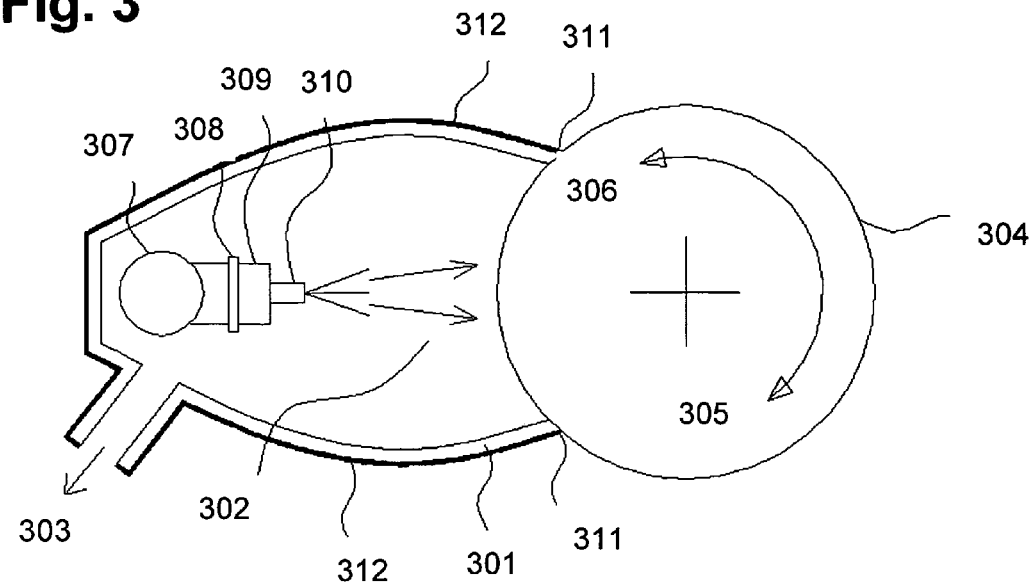
FIG. 3 shows a third embodiment of the invention.

FIG. 3 shows another preferred embodiment 300 of the invention. The shielding means are designed as a box-like chamber 301 which forms together with a work roll 304 an essentially closed space 302. Work roll 304 can be moved either in clockwise 305 or in anti-clockwise direction 306. Via a cryogen feed line 307 liquid nitrogen can be supplied to a fluid header 309 and be sprayed onto the work roll 304 by means of several delivery nozzles 310. Actuators, control valves and sensors 308 can be used to control the cryogen flow to the delivery nozzles 310.

Chamber 301 is further provided with an exhaust duct 303 for withdrawing nitrogen gas from the interior of chamber 301. The edges 311 of chamber 301 which are in contact with the work roll 304 are provided with seals, for example plastic material, to seal the enclosed volume 302 of the chamber 301.

In order to keep the outside wall of chamber 301 at a temperature above the dew point of the surrounding atmosphere an electrical heating element(s) 312 is provided. The electric heating elements 312 warm up the outer wall of the chamber 301 to prevent water from condensing.

Figure 4:
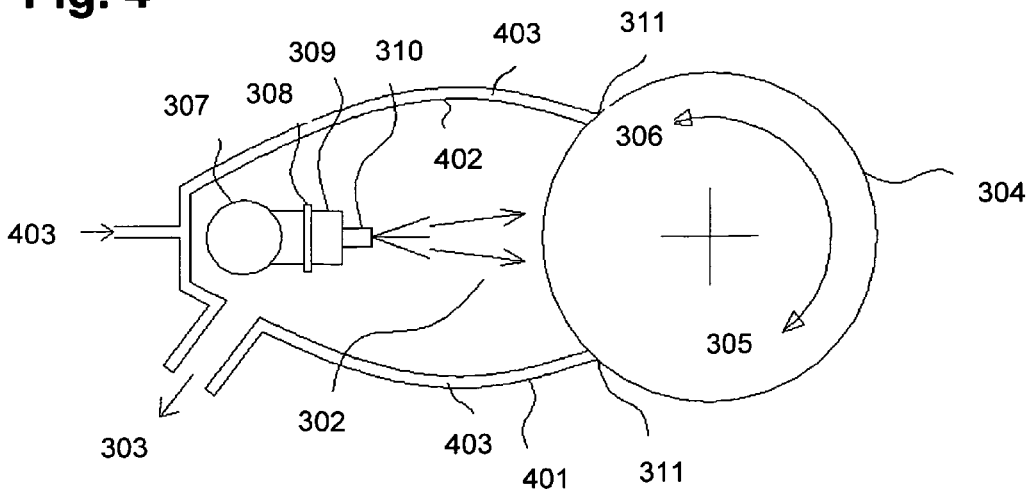
FIG. 4 shows a fourth embodiment of the invention.

FIG. 4 shows another preferred embodiment 400 of the invention which is very similar to the one shown in FIG. 3. In all Figures the same reference numbers refer to the same elements.

According to this embodiment the chamber is designed with double walls 401, 402 forming a gap 403 inbetween. A warm gas, preferably nitrogen gas with ambient temperature, is introduced into the gap 403 forming an insulative layer which keeps the outer wall 401 at a temperature above the dew point of the surrounding atmosphere, preferably above the temperature of the surrounding atmosphere.

Figure 5:
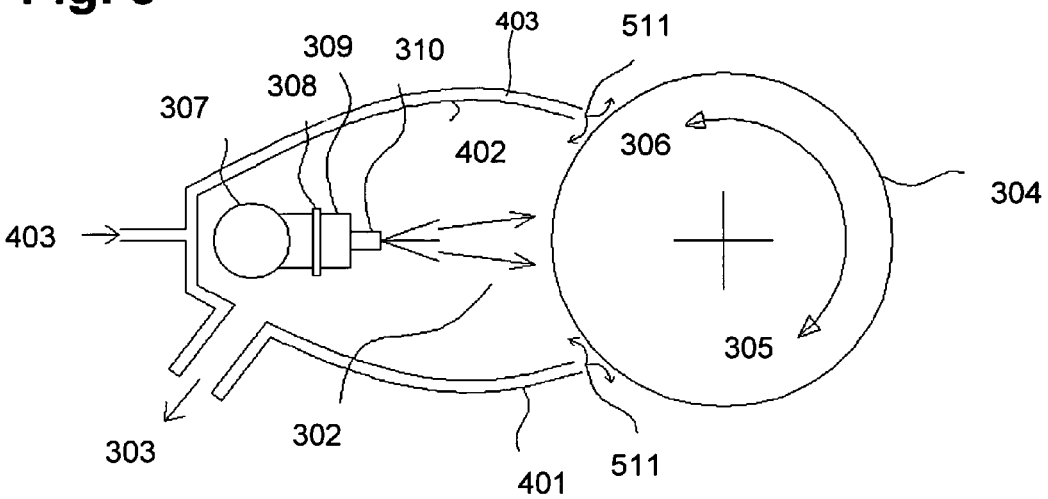
FIG. 5 shows a fifth embodiment of the invention.

FIG. 5 shows another preferred embodiment 500 which differs from the one according to FIG. 4 only in the way of sealing the gap between the chamber and the work roll 304. In this embodiment the sealing of the gap between the chamber and the work roll 304 is achieved by having a gas outlet 511 from the gap 403 between the inner wall 402 and the outer wall 401 of the chamber. The warm nitrogen gas which first acts as an insulator in gap 403 leaves that gap 403 and forms a sealing shroud at the edge by the gas outlet 511 of the chamber, that is at the gap between the chamber and the work roll 304. The pressure of the warm nitrogen gas flowing in the gap 403 is preferably higher than the pressure in the interior 302 of the chamber and higher than atmospheric pressure so that cold gas and liquid cannot escape from the essentially closed space 302, that is from the interior of the chamber, through the gap between the chamber and the work roll 304 and atmospheric air cannot enter the essentially closed space 302.

Figure 6:
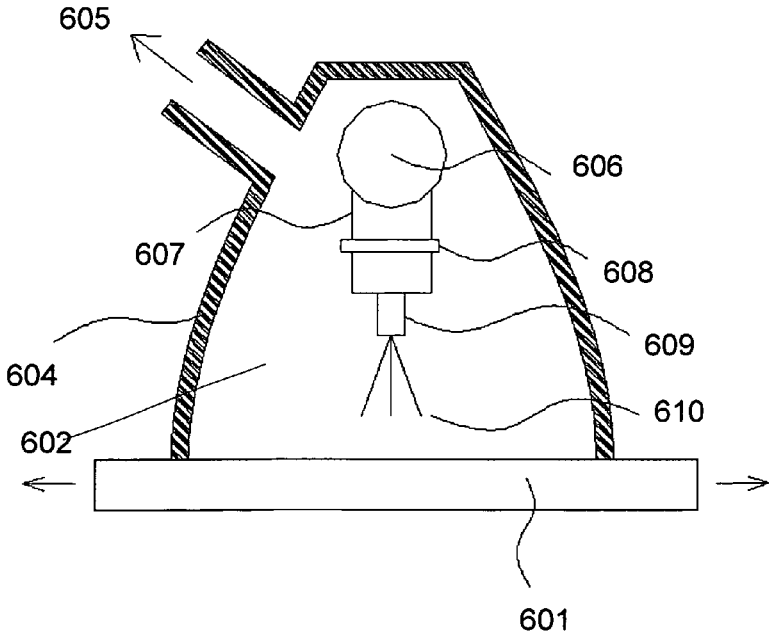
FIG. 6 shows a sixth embodiment of the invention.

FIG. 6 shows another embodiment 600 of the invention. In this case the inventive method is used to cool a flat piece of metal, such as a metal strip 601 which could be either moving or static. In this case the metal strip 601 itself is the work piece. A chamber 604 is positioned on the metal strip 601 such that the chamber 604 together with the metal strip 601 forms an essentially closed space 602. Via a cryogen feed line 606 liquid nitrogen can be supplied to a fluid header and be sprayed onto the metal strip 601 by means of several delivery nozzles 609. Actuators, control valves and sensors 608 can be used to control the cryogen flow to the delivery nozzles 609 and the cryogen spray 610.

Chamber 604 is further provided with an exhaust duct 605 for withdrawing nitrogen gas from the space 602 of chamber 604. The edges of chamber 604 which are in contact with the metal strip 601 can be provided with seals, for example plastic material, to seal the enclosed volume 602 of the chamber 604.

Figure 7:
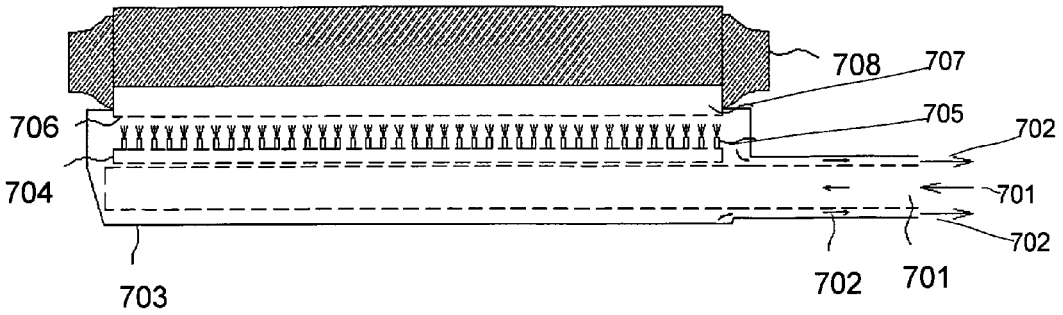
FIG. 7 shows a seventh embodiment of the invention.

Another preferred embodiment 700 of the invention shall be explained with reference to FIG. 7 which shows a side view of a work roll 708 and the inventive apparatus 700 for cooling the work roll 708. The surface 706 of the work roll 708 is subjected to a spray of a plurality of cryogen nozzles 705. Reference number 704 refers to cryogenic equipment such as fluid accumulators, sensors, actuators, fluid header, valves etc. Similar to FIGS. 1 to 6 the cryogen nozzles 705 are surrounded by a chamber 703 which forms an essentially closed space with the work roll 708.

The cryogen, preferably liquid nitrogen, which is sprayed by the nozzles 705 is supplied via a cryogen feed line 701. Cold gas produced during the spraying of the cryogen is withdrawn through an exhaust duct 702. The cryogen feed line 701 is arranged inside the exhaust duct 702. This method ensures that the cold gas surrounds the cryogenic feed line 701 and keeps the atmospheric heat away from the cryogen flowing through feed line 701.

Chamber 703 is preferably provided with an insulation or with double walls, preferably in the region above the strip. At least in the region close to the strip the outer wall of the shielding means should be warm to avoid condensation of humidity. Away from the strip it is not necessary to keep the outer wall warm.

What is claimed is:

1. An apparatus for spraying a coolant to contact a work piece, comprising:

a coolant feed line;

at least one delivery nozzle in fluid communication with the coolant feed line for delivering the coolant; and shield means constructed and arranged to surround at least part of said at least one delivery nozzle, and arranged to coact with the work piece to form a space between the shield means and the work piece, the shield means including:

an exhaust for exhausting gaseous coolant from the space to a location remote from the work piece, and insulation means associated with the shield means for insulating the shield means such that an exterior surface of the shield means is at a temperature above a dew point external to the shield means.

2. The apparatus of claim 1, wherein said insulation means comprises at least one insulator selected from the group consisting of thermal insulation, heating means, and electric heating means.

3. The apparatus of claim 1, wherein said insulation means comprises at least a partial double-wall having an insulation gap therebetween, and a gas disposed in the insulation gap.

4. The apparatus of claim 3, further comprising a gas outlet for the gas in the insulation gap, said gas outlet disposed between said shield means and said work piece, and in fluid communication with a gas supply selected from a group consisting of a gaseous nitrogen supply, and a warm gaseous nitrogen supply.

5. The apparatus of claim 1, further comprising a gap disposed in said shield means and a gas outlet in fluid communication with the gap and disposed between said shield means and said work piece.

6. The apparatus of claim 1, wherein said shield means is constructed and arranged to surround at least two delivery nozzles.

7. The apparatus of claim 1, further comprising a source of cryogenic fluid in fluid communication with the coolant feed line.

8. The apparatus of claim 1, wherein said coolant feed line is at least partly disposed within said exhaust.

9. A method for spraying a coolant to contact a work piece, wherein said coolant is sprayed by at least one delivery nozzle, and shield means surrounds at least part of said at least one delivery nozzle, the method comprising:

arranging said shield means proximate to and coacting with said work piece for forming a space therebetween;

withdrawing gaseous coolant from the space to a location remote from the work piece; and controlling a temperature of an exterior surface of said shield means to be kept at a temperature above a dew point external to the shield means.

10. The method of claim 9, further comprising heating the exterior surface of said shield means.

11. The method of claim 9, further comprising providing a gas to a gap between said shield means and said work piece.

12. The method of claim 11, further comprising controlling a pressure of said gas to be greater than atmospheric pressure of atmosphere at the gap and at the space.

13. The method of claim 9, wherein said coolant comprises a cryogen selected from the group consisting of a cryogenic fluid, and liquid nitrogen.

14. The method of claim 9, further comprising spraying said coolant onto at least one of said work piece and a roll for contacting said work piece.

15. The method of claim 9, further comprising controlling a pressure within the space by adjusting at least one of a flow of coolant sprayed and a flow of gaseous coolant withdrawn from the space.

16. The method of claim 9, further comprising purging said space with a dry gas prior to the coolant being sprayed.

17. The method of claim 9, further comprising controlling a width of a gap between said shield means and said work piece.

* * * * *